United States Patent [19]

Bean

[11] 4,448,512

[45] May 15, 1984

[54] LIGHT MEANS FOR EXPOSING AND LIGHT MEANS FOR DISCHARGING IN A ELECTROPHOTOGRAPHIC PRINTING MACHINE

[75] Inventor: Lloyd F. Bean, Rochester, N.Y.

[73] Assignee: Xerox Corporation, Stamford, Conn.

[21] Appl. No.: 379,610

[22] Filed: May 19, 1982

[51] Int. Cl.[3] ..... G03G 15/00

[52] U.S. Cl. ..... 355/3 R; 355/3 CH; 355/14 E; 355/14 CH; 355/15; 355/7; 355/71; 355/80

[58] Field of Search ..... 355/3 R, 14 R, 71, 80, 355/11, 13, 3 CH, 4, 14 E, 14 CH, 15, 7; 350/15, 370, 372, 374, 379, 380, 392

[56] References Cited

U.S. PATENT DOCUMENTS

| | | | |
|---|---|---|---|
| 3,685,894 | 8/1972 | Lux et al. | 355/11 X |
| 4,076,404 | 2/1978 | Nagamatsu et al. | 355/4 |
| 4,173,406 | 11/1979 | Oyama et al. | 355/3 R |
| 4,236,811 | 12/1980 | Hirose et al. | 355/3 CH |

*Primary Examiner*—A. C. Prescott

*Attorney, Agent, or Firm*—H. Fleischer; J. E. Beck; R. Zibelli

[57] ABSTRACT

An electrophotographic printing machine in which a light image exposing a non-uniform charge pattern formed on a photoconductive member is substantially attenuated to record a latent image thereon. Substantially unattenuated light rays discharge selected portions of the charge pattern. In this manner, fatigue of the photoconductive member is minimized.

11 Claims, 1 Drawing Figure

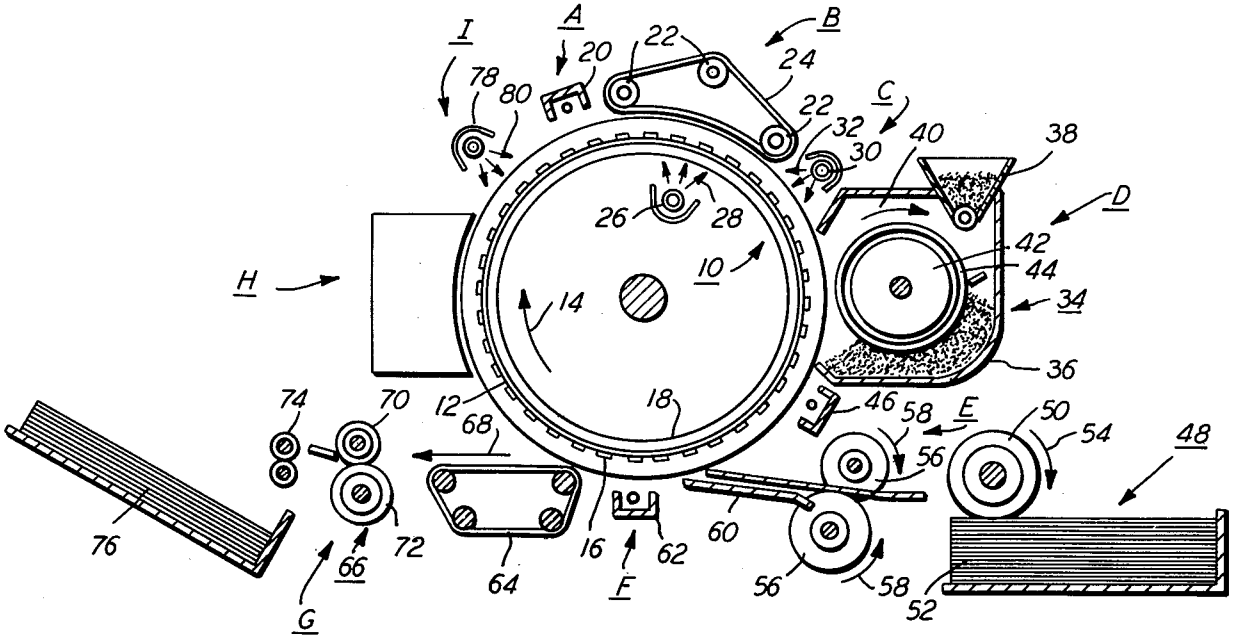
A
B
C
D
E
F
G
H
I
10
12
14
16
18
20
22
24
26
28
30
32
34
36
38
40
42
44
46
48
50
52
54
56
58
60
62
64
66
68
70
72
74
76
78
80

LIGHT MEANS FOR EXPOSING AND LIGHT MEANS FOR DISCHARGING IN A ELECTROPHOTOGRAPHIC PRINTING MACHINE

This invention relates to an electrophotographic printing machine for reproducing an original document on a copy sheet. More particularly, the printing machine of the present invention includes an exposure system wherein the light image formed thereby is substantially attenuated by a combined screen and optical filter disposed on the photoconductive member.

Generally, in the process of electrophotographic printing, a photoconductive member is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. In this way, a powder image is formed on the photoconductive member which is subsequently transferred to a copy sheet. Thereafter, the powder image is permanently affixed to the copy sheet in image configuration.

It has been found that it is highly advantageous to develop the electrostatic latent image recorded on the photoconductive member with uncharged marking particles. However, in order to achieve the foregoing, it is necessary to form a non-uniform charge pattern which corresponds to the latent image. It is also highly desirable to minimize the usage of developer material. To achieve this, the regions which do not have an image thereon should not be developed. This requires that the inter-image space on the photoconductive member must be erased. Furthermore, after the particle image is transferred to the copy sheet, it is desirable to discharge the residual charge remaining on the photoconductive member. Heretofore, this has been achieved by uniformly illuminating the photoconductive member at the respective points in the process. However, it has been found that the combination of exposure and erase result in greater fatigue of the photoconductive member. It is highly desirable to minimize this fatigue. Various approaches have been devised for forming a non-uniform charge pattern on the photoconductive member as well as optically filtering light images. The following disclosures appear to be relevant:

U.S. Pat. No. 4,076,404
Patentee: Nagamatsu et al.
Issued: Feb. 28, 1978

U.S. Pat. No. 4,103,994
Patentee: Bean
Issued: Aug. 1, 1978

U.S. Pat. No. 4,124,287
Patentee: Bean et al.
Issued: Nov. 7, 1978

U.S. Pat. No. 4,282,303
Patentee: Bergen
Issued: Aug. 4, 1981

U.S. Pat. No. 4,289,837
Patentee: Gundlach
Issued: Sept. 15, 1981

U.S. Pat. No. 4,302,094

Patentee: Gundlach et al.
Issued: Nov. 24, 1981

The pertinent portions of the foregoing disclosures may be briefly summarized as follows:

Nagamatsu et al. discloses a photoconductive member including a supporting member, a photoconductive layer, and a transparent insulating layer of a desired color to serve as a color filter. The photoconductive member may have a screen pattern formed therein.

Bean describes a recording member having an array of insulated conductive members in a photoconductive member. An electrical potential difference is generated between the conductive members to form an electrical field in the photoconductive member. A light image of an original document exposes the electrical field to form a latent image corresponding to the original document. The latent image is developed with uncharged insulating particles.

Bean et al. discloses the formation of a non-uniform charge pattern on a photoconductive surface by projecting a screen pattern on the charged surface. The non-uniform charge pattern is exposed to a light image of an original document recording an imagewise non-uniform charge pattern which is developed with uncharged marking particles.

Bergen and Gundlach describe an electrophotographic printing machine employing a transparent or semi-transparent drum such that reflex exposure of the photoconductive layer takes place. The photoconductive layer has a screen thereon to achieve a non-uniform charge pattern.

Gundlach et al. discloses a non-uniform charge field in image configuration recorded on an imaging member. The charge pattern is developed with polar or polarizable toner particles.

In accordance with one aspect of the features of the present invention, there is provided an electrophotographic printing machine including a photoconductive member. Means are provided for charging the photoconductive member. Means, in communication with the photoconductive member, form a non-uniform charge pattern on the photoconductive member and optically filter light rays transmitted thereto. Means expose the non-uniform charge pattern with a light image to record a latent image on the photoconductive member. The light image is substantially attenuated by the forming and filtering means. Means transmit light rays onto selected portions of the photoconductive member to discharge selected regions of the charge pattern. The light rays are substantially unattenuated by the forming and filtering means.

Other aspects of the present invention will become apparent as the following description proceeds and upon reference to the drawing which depicts a schematic elevational view of an electrophotographic printing machine incorporating the features of the present invention therein.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawing. In the drawing, like reference numerals have been used throughout to designate identical elements. The drawing schematically depicts the various components of an electrophotographic printing machine incorporating the features of the present invention therein. It will become evident from the following discussion that these features are equally well suited for use in a wide variety of electrostatographic printing machines, and are not necessarily limited in their application to the particular embodiment depicted herein.

As shown in the drawing, the electrophotographic printing machine employs a transparent or semi-transparent drum, indicated generally by the reference numeral 10. Drum 10 has a cross-sectional configuration such that reflex exposure of photoconductive layer 12 takes place to achieve a non-uniform charge pattern thereon. Drum 10 rotates in the direction of arrow 14 to pass through the various processing stations disposed thereabout. By way of example, drum 10 may comprise a transparent or semi-transparent supporting layer, a photoconductive layer and a transparent insulating layer. Photoconductive layer 12 may have a screen pattern formed therein. Such a screen pattern may be formed by masking of an electrically conductive material or an opaque dielectric material which is formed, as by printing or evaporation, on the surface of photoconductive layer, which is adjacent to the transparent insulating layer. This results in mosaic-like grooves formed in one surface of the supporting member and photoconductive layer 12 superimposed on that surface of the supporting member. As shown in the drawing, a screen 16 comprising dielectric or conductive material may be secured to the free surface of photoconductive layer 12. The screen is of a selected color to attenuate light rays over a preselected bandwidth with light rays outside that bandwidth remaining unattenuated. While it may be desirable to employ a transparent layer over the screen and photoconductive layer, one skilled in the art will appreciate that such a transparent dielectric layer may not be necessary in the various types of printing machine environments. Thus, photoconductive drum 10 includes, at a minimum, a transparent supporting layer 18 having photoconductive layer 12 secured thereto with screen 16 adhering to the free surface thereof. By way of example, screen 16 may be a dot screen or continuous screen. A suitable technique for forming a screen integral with the photoconductive layer is described in U.S. Pat. No. 4,076,404, issued Feb. 28, 1978 to Nagamatsu et al., the relevant portions thereof being hereby incorporated into the present application.

Initially, drum 10 advances a portion thereof beneath charging station A. Preferably, charging station A includes a corona generating device 20 which charges photoconductive surface 12 of drum 10 to a relatively high potential. Screen 16 insures that a non-uniform charge pattern is recorded thereon.

Thereafter, the non-uniform charge pattern formed on photoconductive surface 12 of drum 10 is advanced through exposure station B. At exposure station B, an original document is positioned facedown upon drum 10 by means of rollers 22 and continuous belt 24. At least one of the rollers 22 is driven by a motor, not shown. It is to be understood that both drum 10 and belt 24 can be driven either continuously or in a step fashion depending upon the design characteristics and logic of the particular device. Exposure station B includes a light source 26 positioned interiorly of drum 10. Light rays 28 pass through the imaging member and are reflected from the original document, discharging the non-uniform charge pattern formed on photoconductive layer 12 of drum 10 in image configuration to establish a non-uniform charge pattern in image configuration, i.e. an electrostatic latent image. As previously indicated, screen 16 is made of a selected color adapted to optically filter light rays transmitted therethrough over a preselected bandwidth. The light image of the original document extends over a wide bandwidth. The selected color of screen 16 is such as to substantially attenuate the light image passing therethrough onto the photoconductive surface. Thus, the light rays initially transmitted from the interior of drum 10 on to the original document are attenuated. The resultant light rays transmitted back to the photoconductive layer are once again attenuated by screen 16. In this way, the resultant light image transmitted to photoconductive layer 12 is substantially attenuated.

Next, drum 10 advances the non-uniform electrostatic latent image recorded on the photoconductive surface to erase station C. At erase station C, a light source 30 transmits light rays 32 onto selected charged portions of photoconductive surface 12. These light rays selectively discharge the photoconductive surface. The bandwidth of light rays 32 emitted from light source 30 are selected so as to be substantially unattenuated by screen 16. It is thus clear that light source 30 transmits light rays 32 onto the inter-image region of the photoconductive surface. Corona generating device 20 continuously charges the photoconductive surface. However, the region between successive electrostatic latent images is charged, and, if remaining charged, will attract developer material thereto. This produces an unnecessary usage of the developer material and results in potential contamination and overloading of the cleaning system in the printing machine. In order to avoid this problem, it is desirable to discharge the region between successive electrostatic latent images to prevent this inter-image region from being developed during the development process. In this way, excessive developer material usage is minimized. By optimizing both the exposure and erase features of the printing machine, i.e. through usage of light rays having selected bandwidths and a photoconductive screen for optically filtering selected bandwidths over a prescribed range, fatigue of the photoconductive layer is minimized. The electrostatic latent image advances through erase station C to development station D.

At development station D, a developer unit, indicated generally by the reference numeral 34, transports uncharged marking particles into contact with the photoconductive surface of drum 10. The marking particles, or a portion thereof, are attracted to the non-uniform electrostatic latent image, forming a powder image corresponding to the informational areas of the original document. Development unit 34 includes a housing 36 having a chamber for storing a supply of marking particles therein. A dispenser 38 discharges additional marking particles into the chamber of housing 36 so as to maintain a sufficient supply therein for developing the electrostatic latent image. A developer roller 40 comprising an elongated magnetic cylinder 42 having a rotating non-magnetic sleeve 44 interfit thereover and rotating relatively thereto advances the marking particles into contact with the electrostatic latent image. The electrostatic latent image attracts marking particles thereto rendering the latent image visible. By way of example, the marking particles may be made from uncharged insulating material. Typically, these particles may have a resistivity ranging from about $10^{14}$ to about $10^{17}$ ohm-cm. The particles may be formed from a magnetic material, i.e. a core having an insulating coating thereon.

Continuing now with the various processing stations disposed in the electrophotographic printing machine, after the powder image is formed on the photoconductive surface, drum 10 advances the powder image to corona charging station E. At corona charging station E, a corona generator applies a charge to the powder image. Although it is preferred to use a charge of the same polarity as the charge applied to sensitize the photoconductive layer, it is not critical. This preconditions the particles preparatory to their being transferred to a sheet of support material.

Referring now briefly to the sheet feeding path, a sheet of support material is advanced by sheet feeding apparatus 48 to transfer station E. Sheet feeding apparatus 48 includes a feed roll 50 contacting the uppermost surface of the stack of sheets of support material 52. Feed roll 50 rotates in the direction of arrow 54 to advance the uppermost sheet from stack 52. Registration rollers 56, rotating in the direction of arrow 58, align and forward the advancing sheet of support material into chute 60. Chute 60 directs the advancing sheet of support material into contact with drum 10 in a timed sequence so that the powder image developed thereon contacts the advancing sheet of support material at transfer station F.

Transfer station F includes a corona generating device 62 which sprays ions onto the backside of the sheet of support material, i.e. the side opposed from drum 10. The powder image adhering to drum 10 is then attracted therefrom to the surface of the sheet of support material in contact therewith. After transferring the powder image to the sheet of support material, endless belt conveyor 64 advances the sheet of support material to fixing station G.

Fixing station G includes a fuser assembly, indicated generally by the reference numeral 66. The sheet of support material advances in the direction of arrow 68 into a nip difined by fuser roller 70 and back-up roller 72 of fuser assembly 66. The powder image formed on the sheet of support material in image configuration is heated by fuser roller 70 so as to be permanently affixed to the sheet of support material. After the fusing process, roller 74 advances the sheet of support material with the powder image permanently affixed thereto to catch tray 76 for subsequent removal therefrom by the machine operator.

Invariably, after the sheet of support material is separated from the photoconductive surface of drum 10, some residual particles remain adhering thereto. These residual particles are cleaned from drum 10 at cleaning station H. Cleaning station H includes a cleaning mechanism which may comprise a preclean corona generating device and a rotatably mounted fibrous brush in contact with the photoconductive surface of drum 10. The preclean corona generating device neutralizes the charge attracting the particles to the photoconductive surface. The particles are then cleaned from the photoconductive surface by the rotation of the brush in contact therewith.

Subsequent to cleaning, discharge station I, which comprises a discharge lamp 78, floods the photoconductive surface with light to dissipate any residual charge remaining thereon prior to the charging thereof for the next successive imaging cycle. Light source 78 transmits light rays 80 onto photoconductive layer 12 to discharge any residual charge remaining thereon. Once again, the bandwidth of these light rays is selected such that they remain substantially unattenuated by screen 16.

In recapitulation, the electrophotographic printing machine of the present invention includes a photoconductive member having a dual mode screen. The screen attenuates light rays transmitted to the photoconductive layer over a prescribed bandwidth and modulates the charge to form a non-uniform charge pattern thereon. In this way, light rays of a selected bandwidth are transmitted to the photoconductive layer with light rays outside that bandwidth being substantially attenuated. The light image of the original document is substantially attenuated while the discharge and erase light rays remain unattenuated. This significantly reduces fatigue of the photoconductive layer.

It is, therefore, evident that there has been provided in accordance with the present invention, an electrophotographic printing machine which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine, including:

a photoconductive member;

means for charging said photoconductive member;

means, in communication with said photoconductive member, for forming a non-uniform charge pattern on said photoconductive member and optically filtering light rays transmitted thereto;

means for exposing the non-uniform charge pattern with a light image to record a latent image on said photoconductive member with the light image being substantially attenuated by said forming and filtering means; and means for transmitting light rays onto selected portions of said photoconductive member to discharge selected regions of the charge pattern with the light rays being of a bandwith selected to be substantially unattenuated by said forming and filtering means.

2. A printing machine according to claim 1, further including means for developing the latent image recorded on said photoconductive member with uncharged marking particles to form a particle image thereon.

3. A printing machine according to claim 2, further including means for transferring the particle image to a sheet of support material.

4. A printing machine according to claim 3, further including means for fixing the particle image to the sheet of support material.

5. A printing machine according to claim 4, wherein said forming and filtering means includes a screen of a preselected color positioned adjacent one surface of said photoconductive member, said screen substantially attenuating light rays over a preselected bandwidth with the light rays outside the preselected bandwidth remaining substantially unattenuated.

6. A printing machine according to claim 5, wherein said screen is positioned interiorly of said photoconductive member.

7. A printing machine according to claim 5, wherein said screen is positioned exteriorly of said photoconductive member.

8. A printing machine according to claim 5, wherein said exposing means is positioned to transmit the light image onto the surface of said photoconductive member having said screen adjacent thereto.

9. A printing machine according to claim 8, wherein said transmitting means includes a light source disposed intermediate said exposing means and said developing means to discharge the inter-image region of said photoconductive member.

10. A printing machine according to claim 9, wherein said transmitting means includes a second light source spaced from said first mentioned light source and positioned prior to said charging means and after said transferring means.

11. A printing machine according to claims 9 or 10, wherein said photoconductive member is a drum with said light source being disposed exteriorly thereof and said exposing means interiorly thereof.

* * * * *